US006217162B1

(12) United States Patent
Bowling et al.

(10) Patent No.: US 6,217,162 B1
(45) Date of Patent: Apr. 17, 2001

(54) ALIGNMENT APPARATUS FOR AN INK JET DROPLET GENERATOR

(75) Inventors: Bruce A. Bowling, Beavercreek; Robert J. Simon, Bellbrook; John N. Blum, Kettering, all of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,214

(22) Filed: Dec. 14, 1998

(51) Int. Cl.[7] ..... B41J 2/07; B41J 2/02
(52) U.S. Cl. ..... 347/74; 347/75
(58) Field of Search ..... 29/890.1; 347/74–78

(56) References Cited

U.S. PATENT DOCUMENTS 4,937,589 * 6/1990 Fagerquist et al. ..... 347/75
4,963,220 * 10/1990 Bachmann et al. ..... 156/307.3
5,644,837 * 7/1997 Fathi et al. ..... 29/832
5,812,164 * 9/1998 Bowling ..... 347/75

* cited by examiner

*Primary Examiner*—Thinh Nguyen
(74) *Attorney, Agent, or Firm*—Barbara Joan Haushalter

(57) ABSTRACT

An alignment apparatus and method is provided for attaching and aligning components of an ink jet printhead of a continuous ink jet printer. First and second bonding surfaces are provided on first and second components, respectively, of the ink jet printhead. The first and second components are then aligned and attached. The attaching can be accomplished by applying an adhesive, which may also incorporate a chemical accelerator, or by distributing an adhesive from a central region of the bonding surfaces to create an adhesive bond between the first and second bonding surfaces.

3 Claims, 2 Drawing Sheets

ALIGNMENT APPARATUS FOR AN INK JET DROPLET GENERATOR

TECHNICAL FIELD

The present invention relates to continuous ink jet printers and more particularly to an improved means for assembling and maintaining the alignment of ink jet printhead components using an accelerated attachment means.

BACKGROUND ART

Planar charging ink jet printheads use a droplet emitter (known as a droplet generator) and a plurality of droplet deflection electrodes (known as a charge plate) in precise alignment, which create the "ink jet" technology area of a printhead. Current technology presets two degrees of freedom and uses a manipulation fixture to align the other four degrees of freedom. Screws are tightened once the desired relationship is achieved between the drop generator and the charge plate, such as is disclosed and claimed in U.S. Pat. No. 5,475,409.

However, alignment technicians experience difficultly maintaining this precision alignment between the droplet generator and charge plate when torque is applied to the screws that secure the assembly into its final position; this movement being known as an alignment shift. Additional difficulty occurs at alignment via "sticktion." Sticktion occurs between two coplanar surfaces, in this case a droplet generator and charge plate, when a force is applied while translating one to the other. Lastly, alignment shift of another nature occurs with this design in shipping. That is, shifts happen when accelerations as low as 15 g's are introduced into the printhead assembly, such as during shipping.

Prior art attempts to address the mentioned problems propose eliminating the screws that caused shifts. Unfortunately, those screws were also used for alignment, which is necessary. A proposed solution to sticktion involves the use of external precision rigid stages that are nested together and held to a small clearance between the former coplanar surfaces. Cyanoacrylate (CA) is then applied to this gap to set the desired relationship between the droplet generator and the charge plate, such as in U.S. Pat. No. 5,812,164. Shipping alignment shifts were improved, now requiring 50 g's before movement occurred.

Still, problems persist with even the improved prior art approaches. For example, caution and skill must be used to lay (or caulk) adhesive into a groove that loads capillary channels between two slightly gapped surfaces to secure alignment, while avoiding exposure of other printhead hardware and components to the adhesive. In addition, adhesive simply does not feed into the desired cure areas very well. Also, adhesive cure times can be greater than forty-eight hours. During this time the structure is susceptible to alignment shifts.

It is seen, therefore, that a need exists for an improved means for achieving and maintaining alignment of ink jet printhead components, particularly between the droplet generator and the charge plate.

SUMMARY OF THE INVENTION

It is the object of the present invention to provide an improved means for achieving and maintaining the alignment of printhead components. This object is achieved by accelerating attachment of the ink jet droplet generator, minimizing the problems associated with prior art attachment and cure times. The present invention achieves the additional object of maintaining the alignment of printhead components.

In accordance with one aspect of the present invention, an alignment apparatus and method is provided for attaching and aligning components of an ink jet printhead of a continuous ink jet printer. First and second bonding surfaces are provided on first and second components, respectively, of the ink jet printhead. The first and second components are then aligned and attached. The attaching can be accomplished by applying an adhesive, which may also incorporate a chemical accelerator, or by distributing an adhesive from a central region of the bonding surfaces to create an adhesive bond between the first and second bonding surfaces.

Other objects and advantages of the invention will be apparent from the following description and the appended claims.

DETAILED DESCRIPTION OF THE INVENTION

The present invention proposes a novel approach for accelerating attachment and maintaining alignment of ink jet printhead components. The concept of the present invention, in its preferred embodiment, proposes both geometric and chemical innovations.

Figure 1:
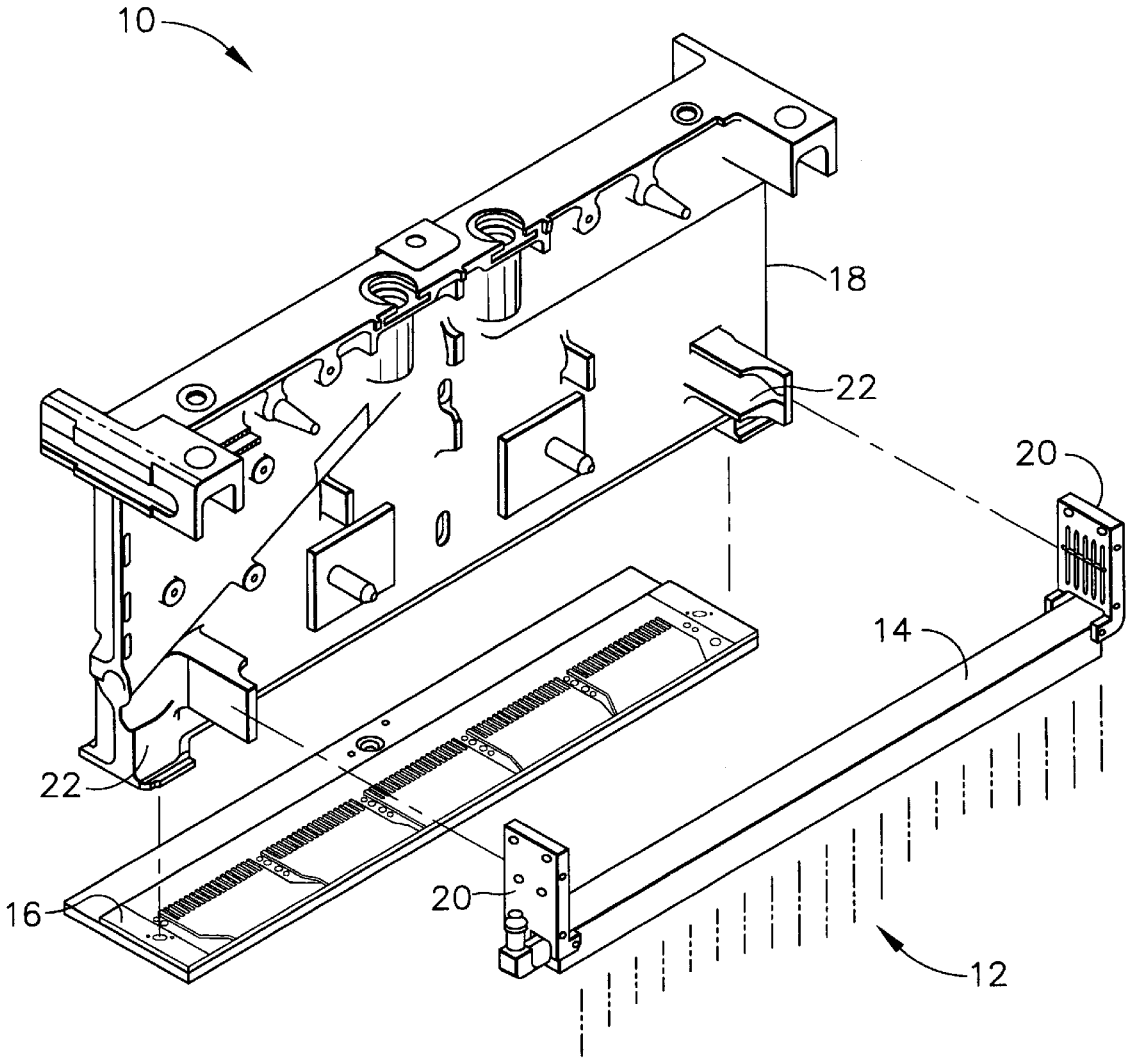
FIG. 1 is a perspective view of an ink jet printhead, illustrating certain of the alignment features of the present invention.

In a continuous ink-jet printhead 10, the jet array 12 emanating from the drop generator 14 must be critically aligned with the charge plate-catcher assembly 16, shown in FIG. 1. One convenient means to align these components first aligns and secures the charge plate-catcher assembly to the printhead frame 18. Then, using hardware which is not shown, the drop generator is aligned to the charge plate-catcher assembly. This alignment is maintained by securing the drop generator mounts 20 to the frame. This may be achieved by means of cyanoacrylate (CA) adhesive or other adhesive applied between the drop generator mounts and the closely spaced, approximately parallel mating surfaces 22 of the frame.

In the prior art, when cyanoacrylate adhesive is applied as a fillet around the perimeter of the surfaces to be bonded, the liquid adhesive at the perimeter prevents air from, leaving the gap between the components. As a result, the adhesive does not fill the gap very well, which reduces the bond strength.

Figure 2A:
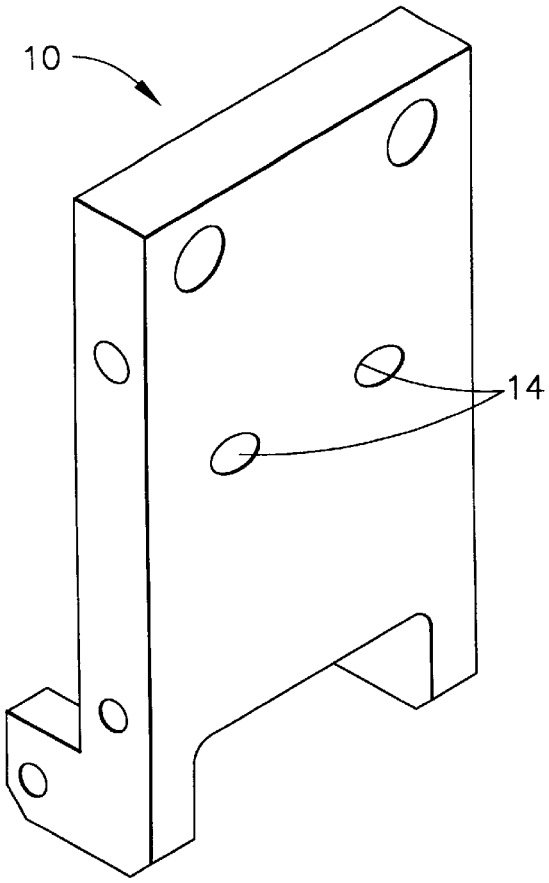
FIGS. 2A and 2B are perspective views of opposing sides of one component of the printhead of FIG. 1, further illustrating alignment features of the present invention.
Figure 2B:
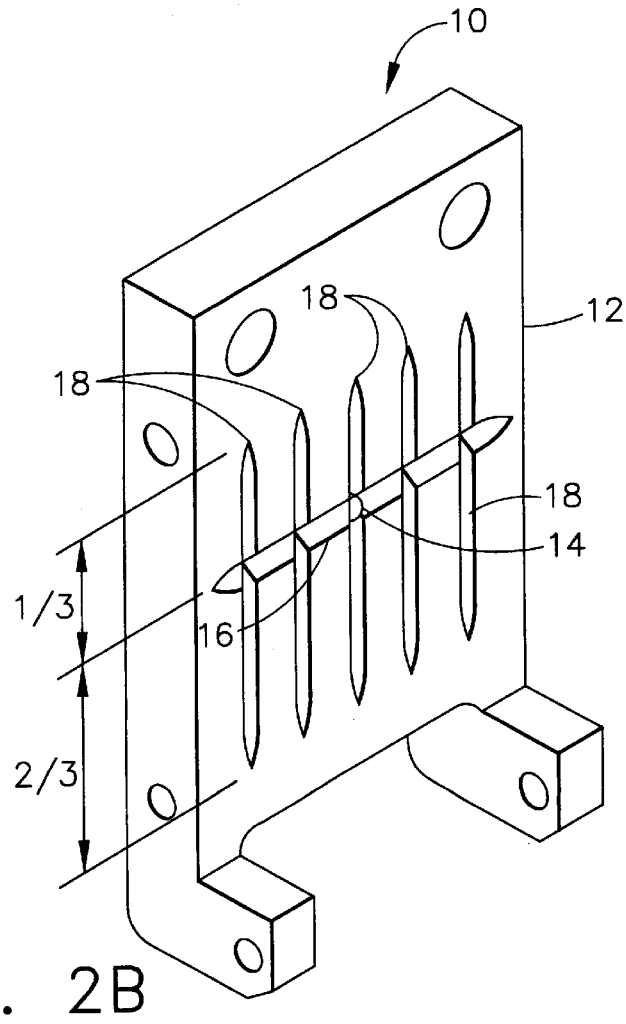

The present invention solves this problem with a central filling channel 12, as shown in FIG. 2B. A fill port 14 is machined through the drop generator mounts. The arrangement of these components can vary and still achieve the same function. For example, it is possible to have the fill port in one component and have the central filling channels in the mating component, so long as the port directs the adhesive into the fill channels. Two fill ports 14 are shown, allowing a common drop generator mount to be used on both left and rights sides of the drop generator. The fill port 14 connects with a horizontal portion 16 of the central filling channel 12. The horizontal filling channel 16 connects with several vertical channels 18. When CA is applied through the filling port 14, the horizontal filling channel 16 distributes the CA to the vertical channels 18 from which, in turn, the CA fills the gap between the drop generator mount and the closely spaced mating surface of the frame.

With the orientation and position as shown in FIGS. 2A and 2B, an optimal central filling channel 12 intersects the vertical channels 18 approximately ⅔ of the way up the vertical channels. By filling the gap from the center, the outward flow of the CA from the central filling channels 16 and 18 displaces the air from the gap. The result of the process of the present invention is a more complete filling of the gap with the adhesive than has heretofore been achieved with prior art configurations.

The filling port 14 configuration according to the present invention has the advantage of helping to eliminate application errors (i.e., spills, drips, etc.) typically associated with the use of adhesive. The fill port 14 preferably comprises a conically sloped aperture in the drop generator mount. The fill port 14 provides absolute accuracy for adhesive placement by guiding the adhesive applicator tip to the desired location. Once in the aperture 14, the adhesive applicator tip stops against the mating gapped surface of the printhead frame. The assembly technician can now confidently apply the appropriate amount of adhesive.

In a further preferred embodiment of the present invention, to enhance productivity, a chemical accelerator may be used. Prior to alignment of the components, the mating surfaces of the drop generator mount and the frame to be bonded can be pre-coated with a chemical accelerator or activator for the cyanoacrylate, such as commercially available n-heptane. Then, after the parts are aligned in accordance with the teachings of the invention, the cyanoacrylate is applied at fill port 14. This reduces cure time on the CA from as much as forty-eight hours to approximately two hours, and allows the assembly to be removed from the alignment hardware more quickly without risk of an alignment shift.

In a further preferred embodiment of the present invention, to enhance the bond strength, the bonding surfaces of the drop generator mount and of the frame are roughed to 60–200 Ra. This increases the surface area for the cyanoacrylate to anchor on to.

The accelerated attachment and improved means for maintaining alignment of printhead components, in accordance with the present invention, results in a more durable printhead. The novel design features of this invention result in printheads which are capable of withstanding 70 g's without an alignment shift.

It will be recognized that features for improved adhesive application, described above as part of the drop generator mount could be located on the printhead frame without altering there effectiveness. It is also possible to machine the adhesive injection apertures into one mating components while the central filling channels are associated with the other component as long as the injection aperture in the one component stays roughly aligned with the filling channels on the mating surface.

The invention has been described in detail with particular reference to certain preferred embodiments thereof, but it will be understood that modifications and variations can be effected within the spirit and scope of the invention.

What is claimed is:

1. An alignment apparatus for attaching and aligning components of an ink jet printhead of a continuous ink jet printer, comprising:

a first bonding surface on a first component of the ink jet printhead;

a second bonding surface on a second component of the ink jet printhead for alignment with the first component; and means to distribute an adhesive from a central region of the first and second bonding surfaces to secure the first bonding surface to the second bonding surface.

2. An alignment apparatus as claimed in claim 1 wherein the adhesive comprises cyanoacrylate.

3. An alignment apparatus as claimed in claim 1 wherein the first and second bonding surfaces are approximately planar.

* * * * *